United States Patent [19]

Schultz et al.

[11] Patent Number: 4,735,770

[45] Date of Patent: Apr. 5, 1988

[54] METHOD FOR PRODUCING AN AMORPHOUS MATERIAL IN POWDER FORM BY PERFORMING A MILLING PROCESS

[75] Inventors: Ludwig Schultz, Bubenreuth; Egon Hellstern, Nuremberg, both of Fed. Rep. of Germany

[73] Assignee: Siemens Aktiengesellschaft, Munich, Fed. Rep. of Germany

[21] Appl. No.: 8,785

[22] Filed: Jan. 29, 1987

[30] Foreign Application Priority Data

Feb. 5, 1986 [DE] Fed. Rep. of Germany ..... 3603549

[51] Int. Cl.[4] ..... B22F 1/00

[52] U.S. Cl. ..... 419/12; 75/244; 148/11.5 P; 148/11.5 Q; 148/126.1; 148/127; 148/132; 148/304; 148/401; 419/23; 419/29; 419/31; 419/32; 419/33; 419/45; 419/46

[58] Field of Search ..... 419/12, 23, 29, 31, 419/32, 33, 45, 46; 75/244; 148/126.1, 127, 11.5 P, 11.5 Q, 132, 304, 401

[56] References Cited

U.S. PATENT DOCUMENTS

| | | | |
|---|---|---|---|
| 3,785,801 | 1/1974 | Benjamin | 75/0.5 BC |
| 4,126,449 | 11/1978 | Ray et al. | 75/164 |
| 4,148,669 | 4/1979 | Ray et al. | 148/3 |
| 4,624,705 | 11/1986 | Jatkar et al. | 419/11 |
| 4,640,816 | 2/1987 | Atzmon et al. | 419/23 |

FOREIGN PATENT DOCUMENTS 8400035 8/1984 PCT Int'l Appl. .

OTHER PUBLICATIONS

C. C. Koch, O. B. Cavin, C. G. McKamey, J. O. Scarbrough, *Applied Physics Lettters*, vol. 43, No. 11, pp. 1017–1019, (Dec. 1, 1983).

Hans Warlimont, *Zeitschrift fur Metallkunde*, vol. 69, 1978, H. 4, pp. 212–220.

R. Haferl, H. R. Kirchmayr, K. Kubaczek, *Electrotechnik Und Maschinenbau*, Sep. 1980, H. 9, pp. 378–385.

J. S. Benjamin, T. E. Volin, *Metallurgical Transactions*, vol. 5, pp. 1929–1934, (Aug. 1974).

J. S. Benjamin, *Scientific American*, vol. 234, pp. 40–48, (1976).

*Primary Examiner*—Stephen J. Lechert, Jr.

*Attorney, Agent, or Firm*—Kenyon & Kenyon

[57] ABSTRACT

By the inventive method, an amorphous material in powder form can be produced, whereby at least two starting components in powder form are mechanically alloyed by means of a milling process so that a boron component which cannot be alloyed mechanically can nevertheless be alloyed. According to the invention, a boron component in powder form is admixed to the starting components; this powder mixture is subjected to the milling process, an amorphous alloying component being formed from the starting components with embedded or deposited fine particles of the boron components; and the mixture powder so produced is subjected to an annealing treatment below the crystallization temperature of the amorphous alloy component for diffusing the boron into the amorphous alloy component.

10 Claims, No Drawings

METHOD FOR PRODUCING AN AMORPHOUS MATERIAL IN POWDER FORM BY PERFORMING A MILLING PROCESS

BACKGROUND OF THE INVENTION a. Field of Invention

The invention relates to a method for producing an amorphous material in powder form, in which two, at least partially crystalline starting components in powder form are mechanically alloyed by means of a milling process.

b. Background

One method for producing an amorphous alloy is described, for instance, in the publication "Applied Physics Letters", Vol. 43, No. 1, Dec. 1, 1983, pages 1017 to 1019.

Amorphous materials sometimes called "metallic glasses" or "vitrous metals" have been known for some time (see, for instance, "Zeitschrift und Maschinenbau", Vol. 97, September 1980, No. 9, pages 378 to 385). These materials are generally special alloys which can be produced from at least two predetermined starting elements or compounds also called alloying components, by means of special methods. According to their compositon, these alloys are generally divided into two classes, following the periodic table of the elements:

1. Metal/metalloid systems, where elements such as Fe, Co, Ni, Cr, Mo, Zr, Ti, etc. can be considered as the metals, and B, Si, C, N, P, Ge, etc. as metalloids.
2. Metal/metal systems, in which the first metal element can be taken from the group of the late transition metals such as Fe, Ni, Co, Cu, etc. and the second element from the group of the early transition elements such as Zr, Ti, Nb, etc., or from the group of the rare earths or actinides.

Such amorphous alloys have, instead of a crystalline structure, a glasslike amorphous structure and exhibit a number of extraordinary properties or property combinations such as high wear or corrosion resistance, great hardness and tensile strength with at the same time high ductility, as well as the case may be, special magnetic properties. In addition, microcrystalline materials with interesting properties can be produced by use of the amorphous state (see, for instance, German Patent No. 28 34 425).

A method, known for some time, for the industrial production of new materials is the so-called "mechanical alloying" (see, for instance, "Metallurgical Transactions", Vol 5, August 1974, pages 1929 to 1934, or "Scientific American", Vol. 234, 1976, pages 40 to 48). In this method, powders of the starting elements or compounds of the desired alloy are milled together in a ball mill to form a powder mixture. The milling process is continued until a homogeneous alloy of the participating components have been produced.

It is now known from the publication mentioned above (Applied Physics Letters) to provide this method of mechanical alloying also for the production of amorphous metals of the above-mentioned second class and in particular of transition metal/transition metal systems in powder form. Accordingly, it is possible, for instance, to prepare powders of amorphous NiNb. The properties of amorphous metals prepared by mechanical alloying correspond in general to those which are produced by the melt spinning method (see also, for instance, the mentioned publications "Z. Metallkde." and "E. u. M.") However, the range of concentrations in which the glasslike structure is formed, can be far larger than with the melt spinning method. In addition, the method of mechanical alloying is very cost-effective, and the corresponding powders have a very clean surface and thereby a very high reactivity which is of advantage, for instance, in sintering processes, but also in catalytic applications.

It is, therefore, an object of the present invention to develop a method for producing amorphous metal/metalloid systems which contain boron as the metalloid, using the method of mechanical alloying.

SUMMARY OF THE INVENTION

These and other objects are achieved by the present invention which is directed to a method for producing an amorphous material in powder form in which two at least partially crystalline starting components in powder form are mechanically alloyed by means of a milling process. This method employs the features:

1. a boron component of elemental boron or a boron compound or alloy is admixed to the powders of the starting components,
2. the powder mixture of (1) is subjected to the milling process, where an amorphous alloying component is formed from the starting components with embedded or settled fine particles of the boron component,
3. the powder mixture so produced by the steps of (2) is subjected to an annealing treatment below the crystallization temperature of the amorphous alloying component for diffusing the boron into the amorphous alloy component.

DETAILED DESCRIPTION OF THE INVENTION

It is known that in a usual method of mechanical alloying the use of boron powders, is not successful for alloying. It has been found that due to its great hardness, boron cannot be alloyed mechanically.

The advantages connected with the invention are therefore in particular that it is possible in spite of these difficulties to produce amorphous materials from special metal/metalloid systems, where also boron powder can be admixed to the starting components in powder form, and the method of mechanical alloying can be used. The metal/metalloid systems are distinguished here from metal/metal systems, for instance, by far greater hardness but also by their special magnetic and corrosion properties, so that they have special importance regarding their possible technical applications.

Advantageous embodiments of the method according to the invention are as follows:

starting components are chosen, with which an amorphous metal/metal system can be formed;

a metal from the group of the late transition metals in the periodic system is preferably chosen as the first starting component;

a metal from the group of early transition metals or rare earths or of the actinides in the periodic system is preferably chosen as the second starting component;

the starting components have preferred particle sizes between 5 μm and 1 mm;

this particle size is especially preferred between 50 μm and 0.5 mm a boron component in powder form with particle sizes below 10 μm and preferably below 1 μm is preferably admixed;

Fe and Zr are preferably provided as starting components where the shares of the components measured in atom percent in the amorphous powder with the composition $(Fe_{1-x}\ Zr_x)_{1-y}B_y$ satisfy the relationships: $20 \leqq x \leqq 80$; $4 \leqq y \leqq 30$;

the powder mixture of the starting components and the B-component is preferably milled for at least 10 but preferably between 10 and 30 hours; and an annealing treatment between about 500° C. and 600° C. is preferably performed.

The invention will be explained further in the following referring to the production of amorphous powder from a special metal/boron alloy $M_1M_2B$).

In this type of alloy, the starting components in powder form which are elements or in the form of alloys or compounds can be provided for $M_1$ and $M_2$, the alloy $M_1$, $M_2$ of which can be one obtained in amorphous form by the known mechanical alloying.

$M_1$ and $M_2$ can be in particular transition metals such as Fe and Zr. Accordingly, a metallic glass of a ternary alloy FeZrB is assumed as the embodiment example.

For producing amorphous powder from this alloy, powders of the two starting components Fe and Zr as well as B-powder are placed first in a suitable milling cup together with hardened steel balls, the mass ratio of the three kinds of powder of this powder mixture being determined by the predetermined resulting atomic concentration of the material to be produced from these powders For the amorphous product of the composition $(Fe_{1-x}Zr_x)_{1-y}B_y$ contents (in atom percent) of the three components are advantageously chosen with $20 \leqq x \leqq 80$ and $4 \leqq y \leqq 30$. Thus a weight ratio of the three elemental powders can be provided, for instance, which after the alloying, corresponds to the composition $Fe_{60}Zr_{20}B_{20}$. The size of the individual powders can be arbitrary but a similar size distribution of the two participating starting components in a range between 5 μm and 1 mm, preferably between 50 μm and 0.5 mm is advantageous. In addition, the B-powder should be as fine as possible, a size of the powder particles being advantageously chosen below 10 μm and preferably below 1 μm. This can involve largely amorphous B-powder. The three powders with corresponding powder particle sizes are placed in a planetary ball mill (Trade Mark, Fritsch: Type "Pulverisette-5") the 100 steel of which, for instance, have diameters of 10 mm each.

The milling intensity can be influenced as desired by varying the ball diameter and the number of balls. Also the milling speed and the ratio of the steel balls to the amount of powder are further parameters which determine the milling time required for making the amorphous powder. In order to prevent surface oxidation of the particles, the milling vessel of the mill consisting of steel is kept in a protective gas, for instance, argon and is opened again only after the completion of the milling process. During the milling process, finely stratified powder grains are initially formed which consist of Fe and Zr layers. In the process, the B-particles are incorporated at the Fe/Zr boundary surfaces as well as into the elemental metals. With advancing milling time, this layer structure becomes finer and finer until at the end of the milling process, after about 10 to 30 hours, amorphous FeZr is present in or on which pulverized B-particles are embedded or deposited. The individual powder particles of the powder mixture so produced have a diameter of about 10 to 200 μm.

The amorphous FeZr material once formed in this way which represents an alloy component of the ternary alloy to be produced, has high thermal stability so that annealing at temperatures up to 600° C. does not lead to crystallization. Accordingly, the mixture powder so produced is therefore subjected to an annealing treatment below the crystallization temperature of the amorphous alloy component FeZr of the two starting components Fe and Zr for several hours. After about 4 hours at 600° C., the B-atoms are diffused into the amorphous FeZr, in the process of which amorphous $Fe_{60}Zr_{20}B_{20}$ has been formed. The amorphous state of this powder so formed can be demonstrated by X-ray examination.

The powder of a metal/metalloid system so produced according to the invention can be processed further by compacting and optionally, in further shaping steps, in a known manner, to form a body or work piece to the desired form and dimension. This body exhibits the properties characteristic of the amorphous material such as great strength at high temperatures.

The method according to the invention explained with the aid of the embodiment example described above produces alloys which consist of three or more components or elements. At least two of the metallic components preferably are capable of being made amorphous by mechanic alloying. To this end, the first starting component $M_1$ can be a late transition metal such as Fe, Ni, Co, Cu, Au, Re, Cr, Mn and the second starting component $M_2$ an early transition metal such as Zr, Ti, Hf, W, Nb, V, Mo or a rare-earth metal, or an actinide metal. The boron provided for the method according to the invention can be in elemental form or can be replaced optionally also in part by another metalloid such as Si, P, C, Ge. For thermodynamic reasons, the metalloid components are advantageously added in elemental form, while the boron can also be present in amorphous form. In special cases, however, these elements can also be added in the form of alloys or compounds such as intermetallic phases $Fe_2B$ or FeB.

What is claimed is:

1. A method for producing an amorphous boron or boron compound containing material in powder form, in which at least two, at least partially crystallized starting metal components are initially alloyed mechanically by means of a milling process, which comprises:

A. mixing a boron component in a powder form of elemental boron or a boron compound or alloy with the starting metal components to produce a powder mixture, B. milling the powder mixture to form an amorphous alloying component of the starting metal components with embedded or deposited fine particles of the boron component, and C. annealing the amorphous alloying component below the crystallization temperature of the amorphous alloying component so that the boron is diffused into the amorphous alloying component thereby producing the amorphous material.

2. A method according to claim 1, wherein starting components are chosen, with which an amorphous metal/metal system can be formed.

3. A method according to claim 2, wherein a metal from the group of the late transition metals in the periodic system is chosen as a first starting component of the at least two starting components.

4. A method according to claim 2, wherein a metal from the group of early transition metals or rare earths or of the actinides in the periodic system is chosen as a second starting component of the at least two starting components.

5. A method according to claim 1, wherein the starting components have particle sizes between 5 μm and 1 mm.

6. A method according to claim 5 wherein the particle size is between 50 μm and 0.5 mm.

7. A method according to claim 1 wherein a boron component in powder form with particle sizes below 10 μm and preferably below 1 μm is admixed.

8. A method according to claim 1 wherein Fe and Zr are provided as starting components where the shares of the components measured in atom percent in the amorphous powder with the composition $(Fe_{1-x}Zr_x)_{1-y}B_y$ satisfy the relationships: $20 \leqq x \leqq 80$; $4 \leqq y \leqq 30$.

9. A method according to claim 8, wherein the powder mixture of the starting components and the B-component is milled for at least 10 but preferably between 10 and 30 hours.

10. A method according to claim 8 wherein an annealing treatment between about 500° C. and 600° C. is performed.

* * * * *